US007610870B1

(12) United States Patent
Zaseybida

(10) Patent No.: US 7,610,870 B1
(45) Date of Patent: Nov. 3, 2009

(54) INTERLOCKING PLATFORM BOATS

(76) Inventor: Norman J. Zaseybida, 2075 Long Street, Kelowna, BC (CA) V1Y 1L3

( * ) Notice: Subject to any disclaimer, the term of this patent is extended or adjusted under 35 U.S.C. 154(b) by 0 days.

(21) Appl. No.: 12/153,855

(22) Filed: May 27, 2008

(51) Int. Cl.
*B63B 9/00* (2006.01)

(52) U.S. Cl. ..... 114/77 R; 114/163

(58) Field of Classification Search ..... 114/346, 114/77 R, 77 A, 163
See application file for complete search history.

(56) References Cited

U.S. PATENT DOCUMENTS

| | | | | |
|---|---|---|---|---|
| 2,826,163 | A | 3/1958 | King | |
| 2,991,744 | A * | 7/1961 | Ensley et al. | 114/61.32 |
| 3,279,417 | A | 10/1966 | Moore et al. | |
| 3,335,436 | A | 8/1967 | Sharp | |
| 3,548,428 | A | 12/1970 | Eades | |
| 3,744,071 | A | 7/1973 | Bossler, Jr. | |
| 3,791,080 | A | 2/1974 | Sjoberg | |
| 3,951,086 | A | 4/1976 | Lown et al. | |
| 4,061,099 | A | 12/1977 | Cook | |
| 4,286,538 | A | 9/1981 | Matsui | |
| 4,366,769 | A | 1/1983 | Lingeman | |
| 5,331,914 | A | 7/1994 | Salmons | |
| 6,637,362 | B1 | 10/2003 | Avidiya | |
| 2004/0028478 | A1 | 2/2004 | Lekhtman | |

* cited by examiner

*Primary Examiner*—Ed Swinehart
(74) *Attorney, Agent, or Firm*—Antony C. Edwards

(57) ABSTRACT

Platform boats intended to be used for motorized boating and for forming-up with adjacent similar boats to form a continuous and contiguous mat of boats for socializing, fishing etc. The adjacent boats interlock and form an array of such boats all interlocked with one another. The boats may be shaped in planform as hexagons or other polygons but are preferably regular polygons which interlock without leaving gaps between adjacent boats. Each boat has a center well in which is mounted a motor. The motor may be rotated 360 degrees for driving the boat in a corresponding direction about a 360 degree range of motion. A pair of rudders is mounted on opposite sides of the center well to provide for directional stability, both in the manner of a keel, and for steering. When used as a keel, the rudders are elevated up into a channel so as to lock them in-line. The rudders may also be lifted entirely up into the channel to store the rudders when not in use. When fully lowered the rudders may be used for steering the boat.

20 Claims, 15 Drawing Sheets

INTERLOCKING PLATFORM BOATS

FIELD OF THE INVENTION

This invention relates to the field of recreational boating and in particular to a boat which may be inter-locked with other such boats so as to form a floating adjacent array of interlocked boats which form a relatively continuous platform which may be linked one to another and un-linked from one another and which are highly maneuverable in a 360 degree range of motion.

BACKGROUND OF THE INVENTION

Recreational boating has been historically, and remains, a vast industry catering to recreational boaters and sportsmen who desire to use their leisure time on the water, whether it be on land-locked bodies of water such as lakes, or on the ocean or, in tidal waters including river deltas and estuaries and the like.

Present invention is directed to those recreational boaters and recreational fishermen who do not desire necessarily high speed boating as is conventionally accomplished using rear driven planning boats, but neither do they necessarily desire the intimate solitude of a fisherman in his belly boat slowly paddling about a secluded lake. Rather, the present invention is designed to service a niche falling in between, and in particular where a single watercraft according to the present invention may be used for relatively gentle translation over a body of water, desirably during calm conditions, and where the end use of the boat may be for fishing, or merely to safely join-up as better described below with other such boats for picnicking or other socializing on the boat or platform formed by multiple boats. Social networking and like recreational activity is often now found amongst boaters who tie-up to each other in entirely dissimilar boats while floating as a flotilla offshore so that the people aboard may socialize between various boats in the flotilla including moving between the various boats. It is an object of the present invention to provide for a number of similar or identical open-hulled boats, where each of the boats advantageously is shaped as the same regular polygon in planform, the example being provided with a hexagon planform shape so that numerous such watercraft may interlock to one another to form a safe social networking platform flotilla. Because of their regular polygon shape, additional watercraft may join in easily to add to the mat of watercraft forming the flotilla. The standardizing of the size and shape of the hull, and the use of regular polygons in planform shape for the hulls, provides for ease of interlocking because adjacent gunwales between adjacent watercraft will be substantially at the same elevation, with the exception of relative movement between the two watercraft due to wave action. Thus, adjacent watercraft may be relatively easily swapped for one another in the array of watercraft, and interlocked in generally calm water so as to allow relative movement between them while maintaining safety in the interlocking between adjacent watercraft in the array of such interlocked watercraft by the use of inter-filling flexible strips between adjacent boats. Advantageously the strips are sized and shaped to continuously and contiguously fill-in the gaps between boats to increase the safety for passengers transferring between boats.

In the prior art the applicant is aware of the following United States Patents which are directed to watercraft having hulls with a round planform shape, in the centre of which are mounted a propulsive motor: U.S. Pat. No. 2,826,163 which issued Mar. 11, 1958 to King entitled Circular Boat, U.S. Pat. No. 3,279,417 which issued Oct. 18, 1966 to Moor et al for a water vehicle, U.S. Pat. No. 3,335,436 which issued Aug. 15, 1967 to Sharp for Water-bourn Vessels, and U.S. Pat. No. 3,548,428 which issued on Dec. 22, 1970 to Eades for a Circular Pleasure Boat.

With respect to the latter, Eades discloses a substantially cup or dish-shaped hull provided with a seat extending around the inner periphery of its wall. Upstanding walls centrally connected to the bottom of the hull define a vertical motor accommodating opening extending through the bottom of the hull. Rams raise and lower the motor. The motor is intended to be a small outboard type motor for moving the boat and manipulating the boat so that the boat will spin or rotate about its vertical axis. The boat is intended for use in relatively shallow waters adjacent to shore. Airtight compartments, forming the seats and reinforcing ribs, add to the buoyancy of the boat. A pair of parallel spaced apart reinforcing ridges 18 are mounted so as to depend from the surface of the substantially flat-like bottom of the boat.

SUMMARY OF THE INVENTION

The hexagonal platform boats according to one embodiment of the present invention are intended to be used for motorized boating and for forming-up with adjacent similar boats to form a continuous and contiguous mat or platform of boats for socializing, fishing etc. The adjacent boats interlock and form an array of such boats all interlocked with one another. The typical diameter of each platform boat may be 8 to 9 feet across and each boat may have seats around its inner perimeter. The boats may be shaped in planform as hexagons or other polygons but are preferably regular polygons which interlock without leaving gaps between adjacent boats to form the continuous and contiguous array of boats.

Each boat has a center well in which is mounted a motor, for example an electric motor powered by batteries stored under the seats The motor may be rotated 360 degrees for driving the boat in a corresponding direction about a 360 degree range of motion. A pair of rudders is mounted on opposite sides of the center well to provide for directional stability, both in the manner of a keel, and for steering. When used as a keel, the rudders are elevated up into a channel so as to lock them in-line. The rudders may also be lifted entirely up into the channel to store the rudders when not in use or to protect the rudders when beaching the boat. When fully lowered the rudders may be independently steered or may be interlinked by a chain drive so that they may be steered simultaneously. When interlocked to form an array or mat, in one embodiment the boats are separated from each other by for example 2 to 3 inches using flexible planar members that mate substantially continuously across the separation between the boats and entirely around the adjacent gunwales of the boats to increase safety by removing gaps.

Thus in one aspect the interlocking platform boats according to the present invention may be characterised as watercraft which include a hull having a gunwale substantially continuously therearound defining a regular polygon, for example a hexagon, in shape around said gunwale. Thus the gunwale and hull have at least first, second, and third sides contiguous to one another. In preferred embodiments the regular polygons are either triangles, squares, or hexagons, so long as all boats have the same planform shape, so that a plurality of such boats may join together relatively seamlessly to create a platform or mat without gaps between boats once the flexible strips are mounted in contiguous strips between all the gunwales of adjacent boats.

The hull has retractably mounted thereto an oppositely disposed pair of elongate substantially horizontally extending first and second rudders. Each rudder is rotatably mounted to the hull by a corresponding substantially parallel spaced apart pair of substantially vertical steering shafts. The lowermost ends of the shafts lie on a virtual keel line along a lowermost portion of the hull. The rudders are rigidly mounted to the lowermost ends of the shafts so as to lie along the keel line when the rudders are co-linearly aligned. Rotation of one or both of the shafts pivots one or both of the rudders correspondingly. The upper ends of the shafts extend upwardly along and are mounted to a rigid steering tower rigidly mounted substantially centrally in a footwell cavity defined in the hull, between the perimeter seats and the steering tower.

The steering tower has a central hollow core. The hollow core is hollow between a lower-most opening in said hull, the opening located between said lowermost ends of said shafts and an upper opening in said tower adapted for rotatable mounting into an operative position of an outboard motor thereto. The outboard motor is mountable into the tower so as to operatively position a throttle and steering control of the motor above said tower and so as to position a lowermost propulsion end of the motor below said tower and hull when the motor is lowered downwardly through the hollow core for use.

The steering shafts on which the rudders are mounted are vertically displaceable relative to the tower between a stowed position wherein the rudders are snugged up against the hull so as to be positioned in a fixed orientation aligned along the keel line, and a lowered position clear of the hull for free-steering of the rudders relative to the hull. The shafts may for example be telescopically mounted in the tower. In one preferred embodiment a channel is formed in the hull along the keel line. The rudders in their stowed position mate at least partially into the channel for fixing the fixed orientation of the rudders along the keel line. Rudder steering handles are provided on the upper ends of the shafts for steering of the rudders.

In use, the hollow core is a waterwell when said hull is floating in a body of water whereby the water in said core rises to a level in said core substantially equal to a waterline of said hull. In one embodiment the motor is mountable in the upper end of said tower by a collar assembly mounted to said tower for rotatably supporting the motor in said core. The motor depends downwardly from said collar assembly to engage the propulsion end of the motor into the water below said hull when the motor is lowered for use and to elevate the propulsion end of the motor up into the well when the motor is raised to its stowed position. The collar assembly is releasably mountable onto the motor and adapted so as to provide for selectively raising and lowering the motor relative to said collar assembly. The tower and said collar assembly are adapted to allow 360 degree rotation of the motor relative to said tower for selectively translating said hull in any direction in the range of motion over the surface of the body of water.

For interlocking adjacent boats, gunwale mats which for are for example planar flexible members, are provided which are mountable to the gunwales for mounting adjacent hulls alongside one another without gaps between boats. Advantageously, for ease of interlocking, each adjacent watercraft is substantially identical to another. This aids the gunwale mats in mounting each watercraft closely adjacent to another such watercraft. Further advantageously, the gunwale mats are planar members having opposite long sides, where one long side is mountable to a gunwale of a first watercraft and where the opposite long side of the planar member is mountable to the corresponding gunwale of an adjacent second watercraft. The planar members may also be resilient as well as flexible.

In one embodiment the watercraft include rails which are releasably mounted to the gunwales. The rails maybe mounted to the gunwales by means of anchors including anchoring posts mounted in the gunwales. The gunwale mats are mountable to the anchors by anchor means including for example pins, bolts, clamps or other releasable fasteners, once the rails have been de-mounted from the anchors or otherwise removed from the gunwales.

At least one seat is mounted around a corresponding portion of an inner circumference of the gunwales and side walls of the hull. The footwell is formed between at least one seat and the tower. In one embodiment the at least one seat is a plurality of seats extending substantially entirely around the inner circumference of the gunwales and side walls of the hull. At least one storage compartment is formed under a corresponding seat.

BRIEF DESCRIPTION OF THE DRAWINGS

With reference to the drawing wherein similar characters of reference denote corresponding parts in each view.

DETAILED DESCRIPTION OF EMBODIMENTS OF THE INVENTION

Figure 1A:
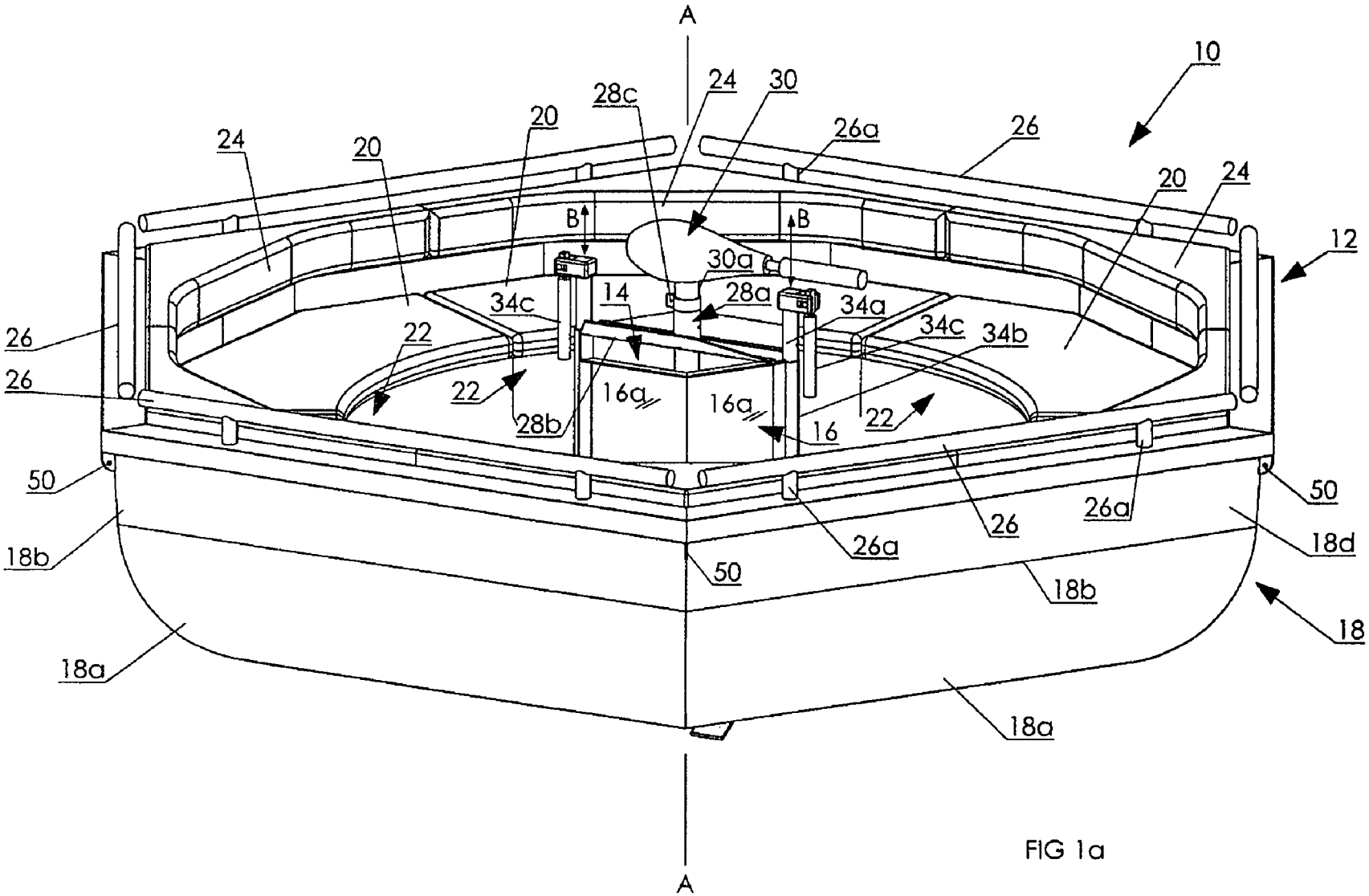
FIG. 1*a* is in left-front, top perspective view, a single watercraft according to one embodiment of the present invention showing the outboard motor lowered for use and the pair of rudder steering shafts elevated.

Platform boats 10 are intended in the present invention to be used for motorized boating and for forming-up with adjacent similar platform boats for socializing as between the boats or for cooperative fishing ventures or the like. The platform boats 10 may, as illustrated, be hexagonal in planform or may be other polygons, including advantageously regular polygons, preferably hexagons, squares or triangles so that they may be formed up without gaps between adjacent boats. The platform boats 10 may be mated to one another so as to releasably interlock to thereby form a mat all interlocked with their next closest neighbouring boat.

As described in more detail below, the typical diameter of a platform boat 10 according to the present invention may be approximately 8 to 9 feet in diameter, across its longest diagonal dimension, and preferably each boat has seats around the internal perimeter of its gunwales 12. Each boat 10 has a centre waterwell 14. Centre waterwell 14 is contained within a rigid steering tower 16.

Hull 18 includes a lower portion 18*a* which extends downwardly from chines 18*b* so as to merge with an approximately planar base portion 18*c*. Hull 18 further includes sides 18*d* which extend upwardly from chines 18*b* to gunwales 12. Gunwale main frames 12*a* are mounted in and around gunwales 12.

Figure 1B:
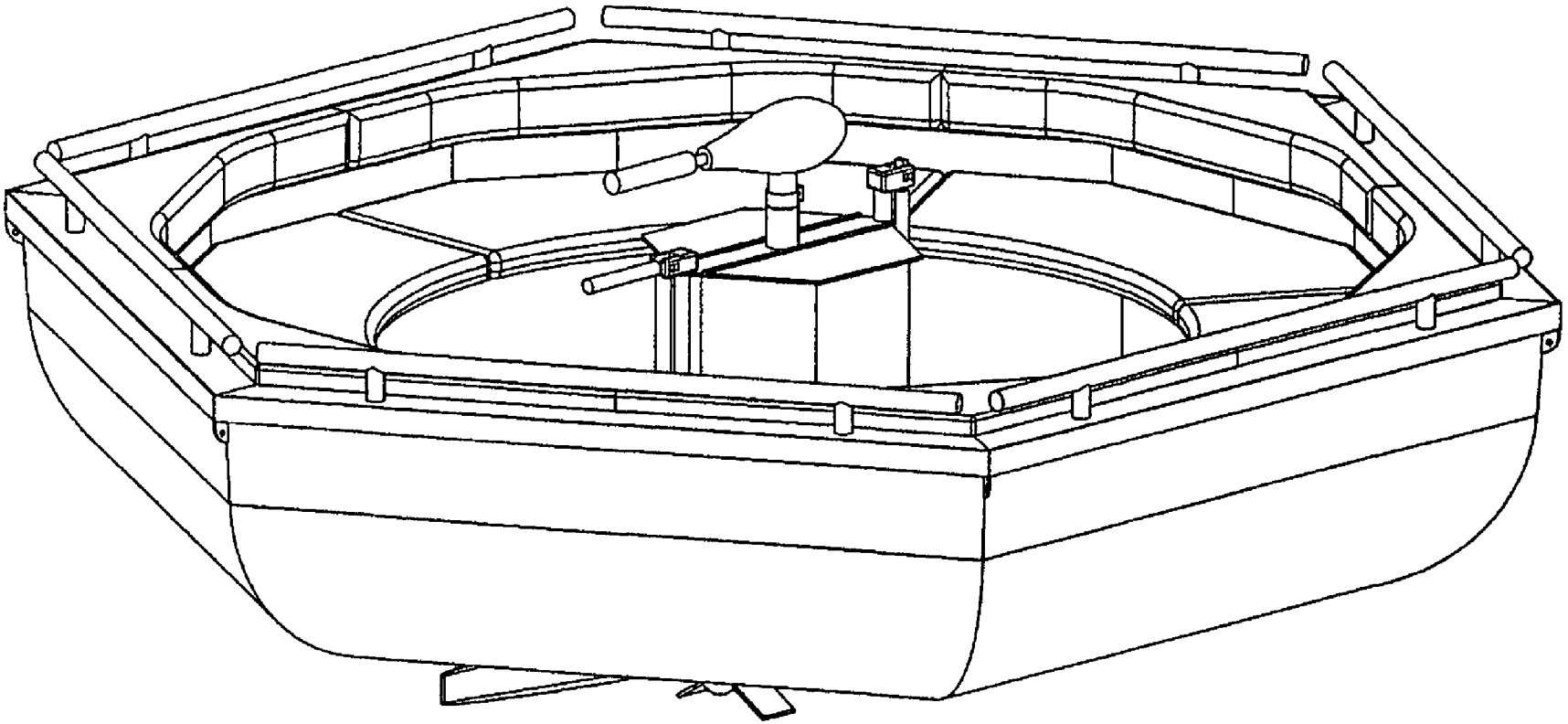
FIG. 1*b* is, in right-front, top perspective view, the watercraft of FIG. 1*a* showing one rudder steering shaft and its corresponding rudder fully lowered, and the opposite steering rudder shaft partially lowered.
Figure 2:
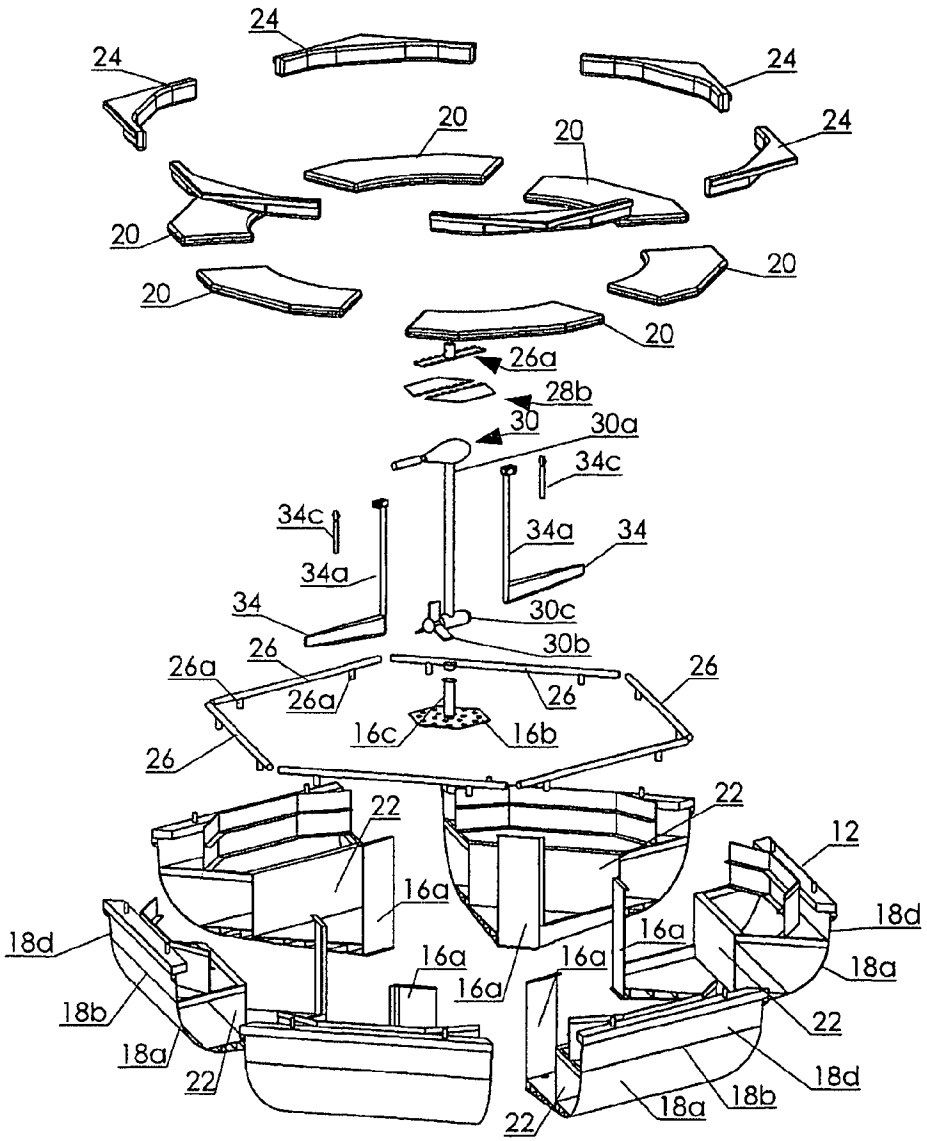
FIG. 2 is an exploded view of the watercraft of FIG. 1*b*.

Thus as seen in FIG. 1, hull 18 and gunwales 12 define a substantially hexagonally shaped interior volume or cavity within the hull and bounded by the gunwales 12 in which are mounted seats 20 on top of bulwarks 22 better seen in the exploded view of FIG. 2. Seats 20 rest on bulwarks 22 and may include back rests 24 advantageously mounted so as to extend between seats 20 and gunwales 12. Rails 26 may be mounted on top gunwales 12 by means of mounting posts 26*a* or 40 seated in corresponding sockets formed in spaced array along the uppermost edge of the gunwales.

As best seen in FIG. 2, tower 16 may in the preferred embodiment be formed by the intersection of six modular tower sides 16*a* which together form a hexagonal tower 16. Hull 18 is radially symmetric about a vertical axis of symmetry A passing collinearly through the longitudinal centroidal axis of tower 16, which itself is centrally positioned within hull 18.

Motor mounts 28 are mounted within tower 16 to support a motor such as an electric motor 30 in tower 16 and substantially along axis A. Motor mounts 28 may include in one embodiment which is not intending to be limiting, a collar assembly 28*a* which is supported on the top of tower 16 by rigid brackets 28*b*. Collar assembly 28*a* clamps onto the drive shaft housing 30*a* of motor 30 so as to allow for the selective raising and lowering of motor 30 relative to tower 16 by for example the use of clamp 28*c*. Thus motor 30 may be elevated or lowered along axis A so as to lower propellers 30*b* and propeller drive motor unit 30*c* below bull base 18*c*. Motor 30 may be an electric motor, for example, modified from a Minn Kota™ model 79-8581-2, 36 inch shaft, 36 lb electric motor.

In a preferred embodiment, a perforated floor 16*b* is slidably mounted in well 14 snugly between sides 16*a*. A lower motor support 16*c* is mounted to floor 16*b*. Lower motor support 16*c* is mounted to the lower end of shaft 30*a* of motor 30 thus floor 16*b* is raised or lowered along with motor 30. Advantageously, floor 16*b* is mounted approximately two-thirds of the way down along the length of housing 30*a* so as to provide sufficient support for the lower end of motor 30. When raised, floor 16*b* defines a lower cavity in the lowermost end of tower 16, that end which is substantially filled with water, so that in its stowed position, motor 30 is retracted to protect propellers 30*b* and drive motor unit 30*c* up in cavity 16*d* underneath tower floor 16*b*. Where motor 30 is an electric motor, typically the electrical controls are mounted in the upper housing (from which the steering handle protrudes), and wires extend down the shaft 30*a* to the motor in the drive motor unit 30*c* so as to drive propellers 30*b*.

Independently actuable rudders 34 are rigid and elongate horizontally. They are rigidly mounted to, so as to extend horizontally cantilevered from, steering shafts 34*a*. Steering shafts 34*a* are rotatively mounted to the sides of tower 16 for example by means of being rotatably snugly journalled within elongate sleeves 34*b* mounted as a parallel spaced apart pair of such sleeves on opposite sides of tower 16. Collapsible steering handles 34*c* may be pivotally mounted to the upper most ends of steering shafts 34*a* and pivotally mounted there to so as to be foldable into a downwardly disposed position preferably parallel to, so as to be neatly tucked away along, steering shafts 34*a* and sleeves 34*b*. Steering shafts 34*a* may be slid telescopically in directions B so as to either lower or retract rudders 34 vertically upward.

In a preferred embodiment, hull 18 and in particular hull base 18*c* includes an oppositely disposed pair of co-linear channels 36 formed in base 18*c* along a virtual keel line C. Keel line C extends radially outwardly from axis A from opposite sides of the lowermost opening into lower cavity 16*d* of tower 16. Channels 36 are sized and shaped so that rudders 34 may be mated into channels 36 once rudders 34 are aligned with keel line C and elevated by the raising of steering shafts 34*a* in direction B. Thus in one embodiment, channels 36 are deep enough so that rudders 34 may be at least partially lifted up into the channels and in a preferred embodiment the channels are deep enough so that the rudders may be flush mounted once lifted up into the channels so that a lowermost edge of the rudders is substantially flush with base 18*c*.

Figure 3A:
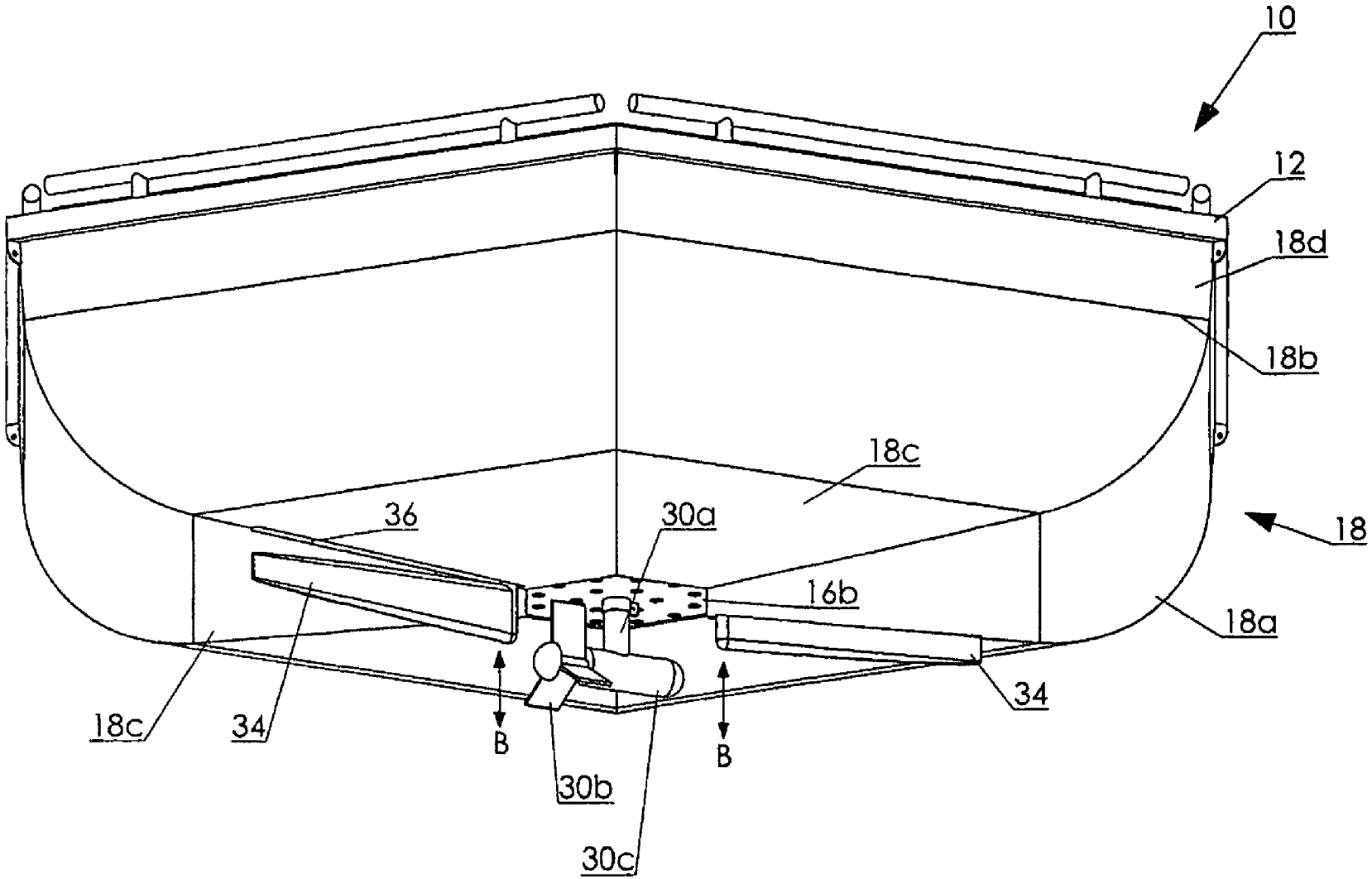
FIG. 3*a* is, in right-front, bottom perspective view, the watercraft of FIG. 1*b* illustrating, as described with respect to FIG. 1*b*, one rudder fully lowered, and the opposite rudder only partially lowered.
Figure 3B:
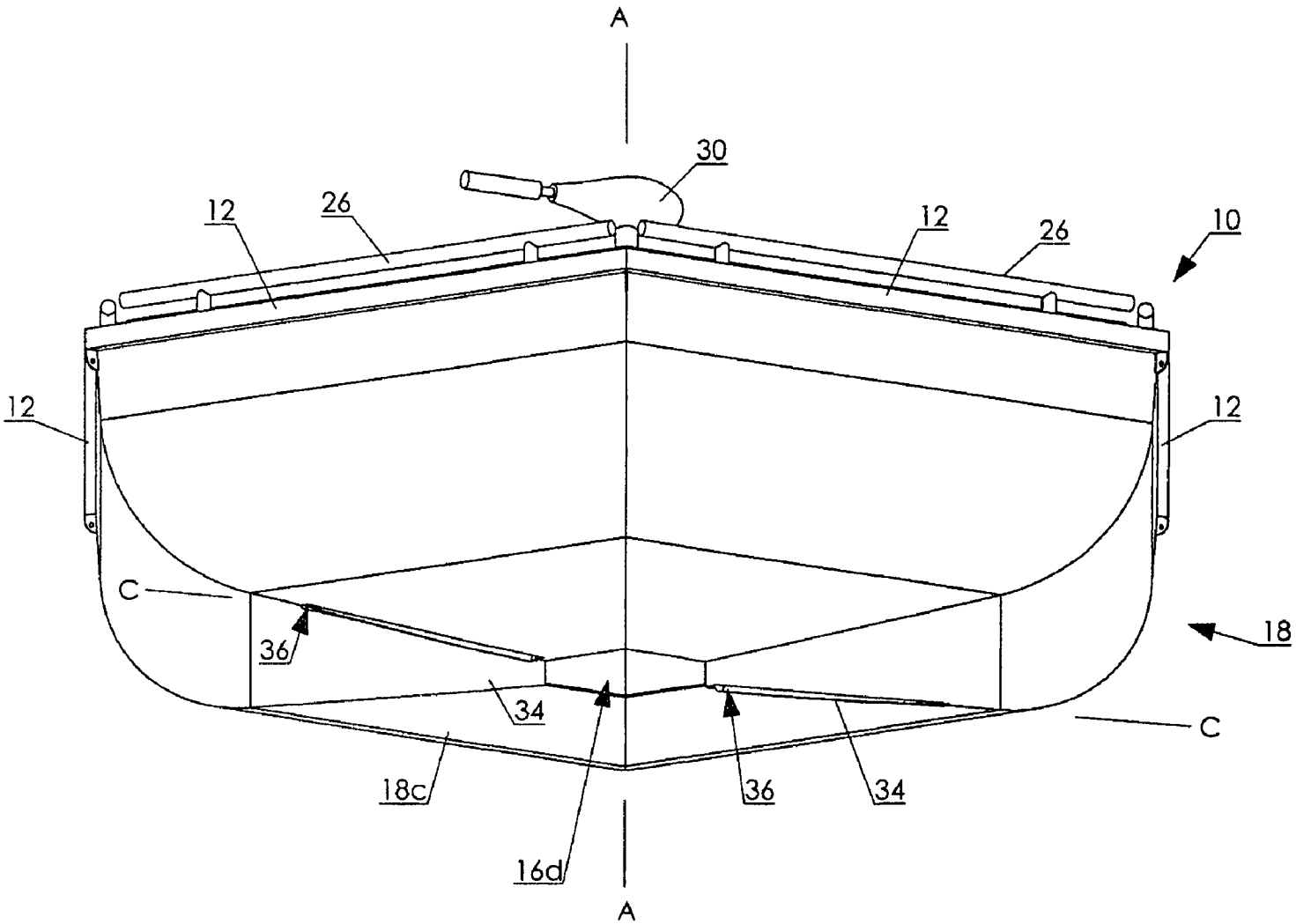
FIG. 3*b* is the view of FIG. 3*a* with both rudders fully retracted and with the motor raised.
Figure 3C:
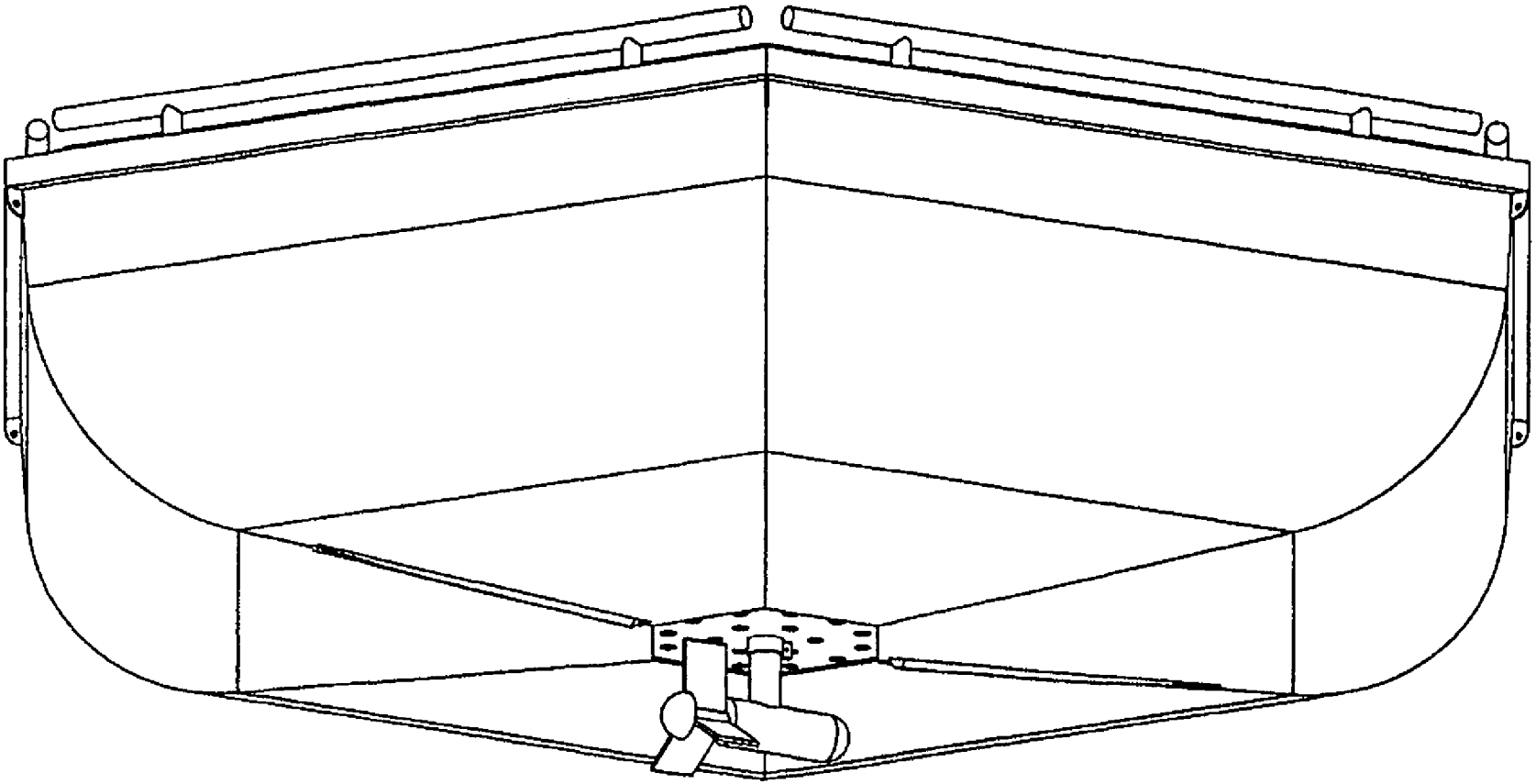
FIG. 3*c* is the view of FIG. 3*a* with both rudders fully retracted.

A locking or friction means as would be known to one skilled in the art is preferably provided cooperating between sleeves 34*b* and steering shafts 34*a* for example so as to provide the selective locking of steering shafts 34*a* at a desired elevation relative to tower 16. Thus rudders 34 may be selectively locked into place extending from channels 36 to thereby provide a keel depending downwardly below hull 18. When it is desired to beach hull 18, rudders 34 may be retracted fully up into channels 36 to protect the rudders as seen in FIG. 3, wherein, also, motor 30 has been retracted to draw the propellers and drive motor unit up into the safety of cavity 16*d*. When it is desired to steer hull 18, one or both of the rudders are lowered by lowering steering shafts 34*a* in sleeves 34*b* to for example their full lowered extension as seen in FIG. 3*b* and pivoting handles 34*c* to the horizontal so as to provide steering control. Steering control may be independent steering, or interlinked steering for example by means of a continuous chain drive, (not shown). Steering control provides for turning hull 18 about axis A in any desired direction of rotation and for accurate positioning of hull 18 for precise docking along side other such platform boats 10 so as to allow for interlocking as better described below.

Figure 5A:
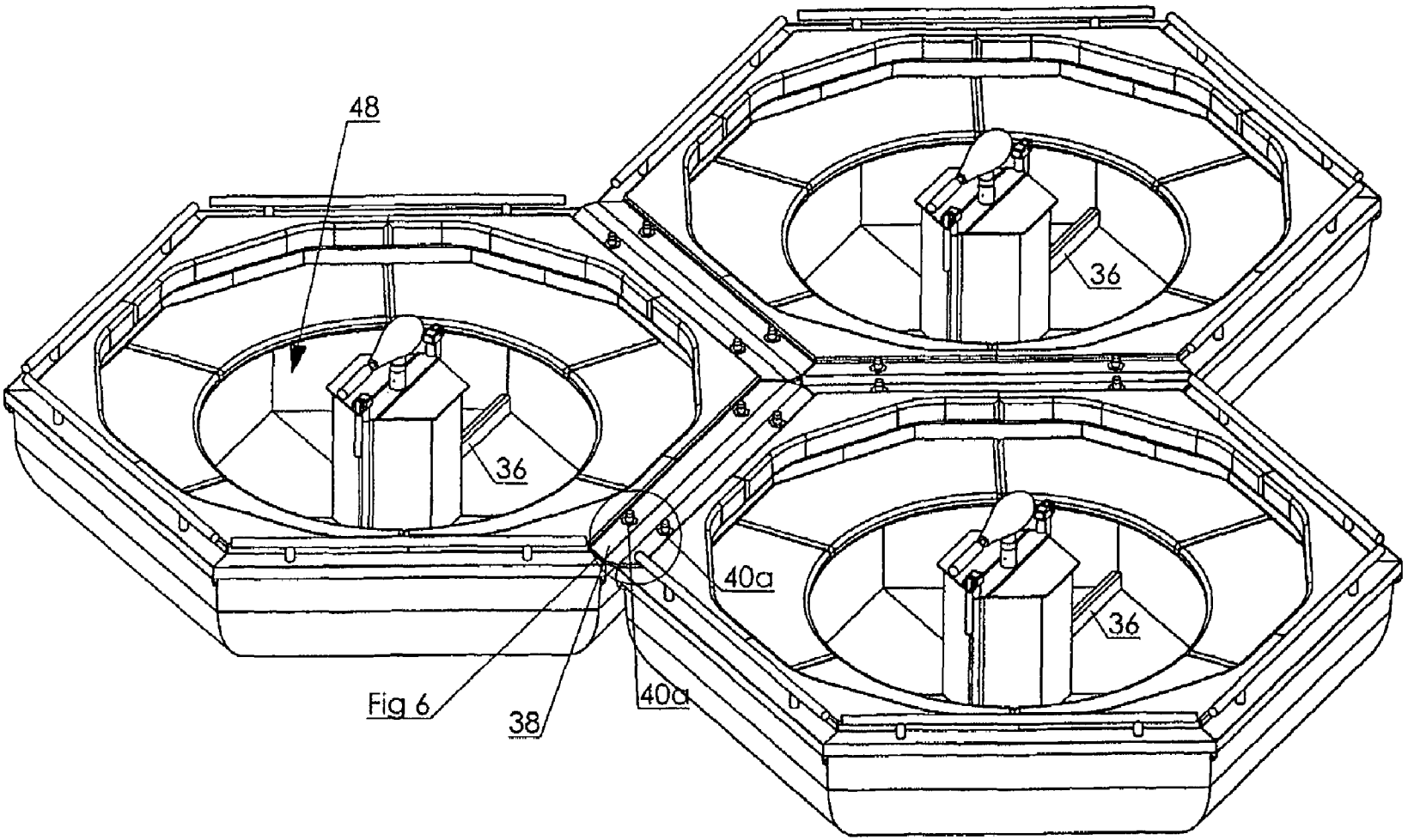
FIG. 5*a* is, in top perspective view, three watercraft according to the present invention interlocked to one another to form a mat.
Figure 5B:
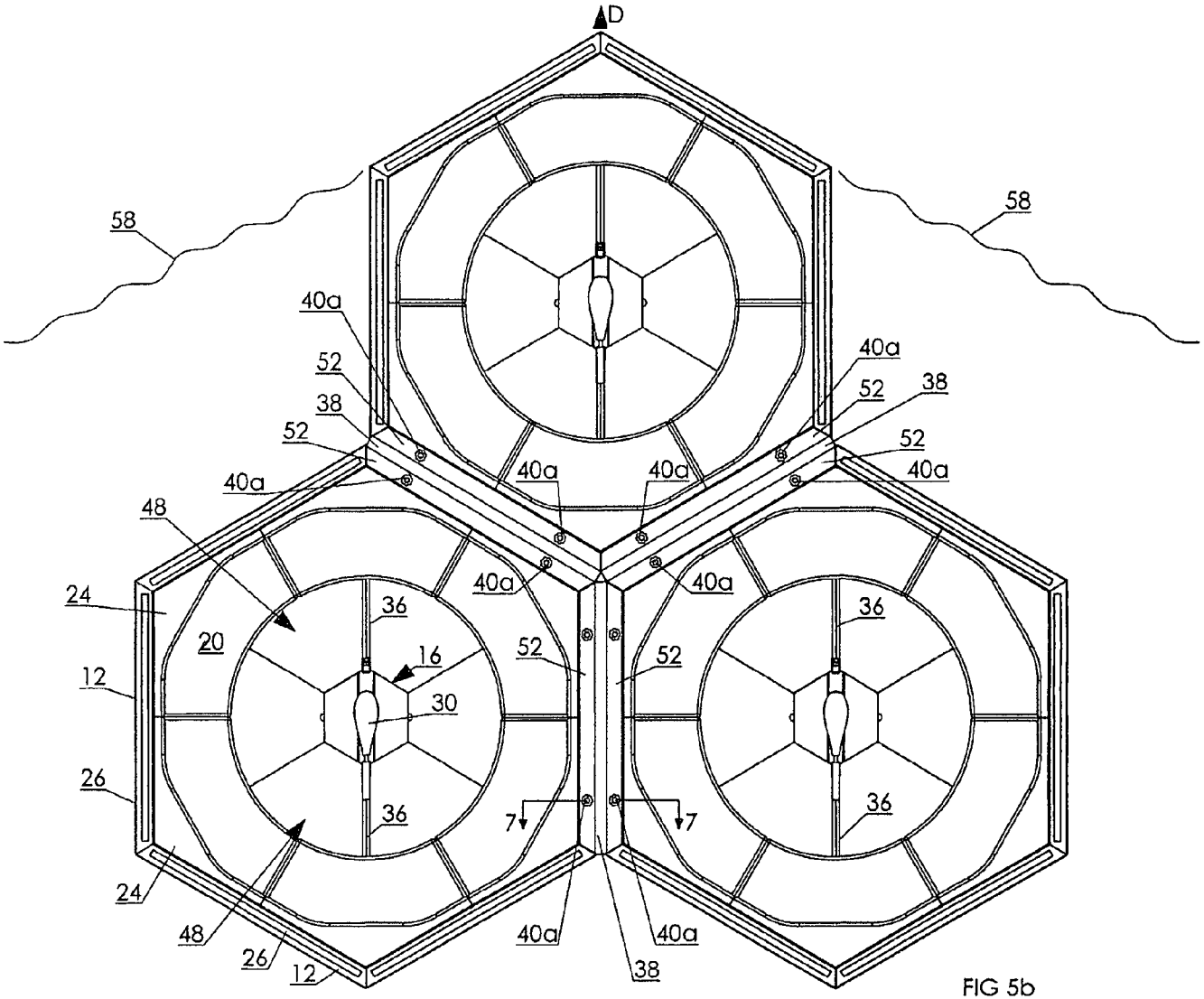
FIG. 5*b* is, in plan view, the three watercraft of FIG. 5*a*.
Figure 5C:
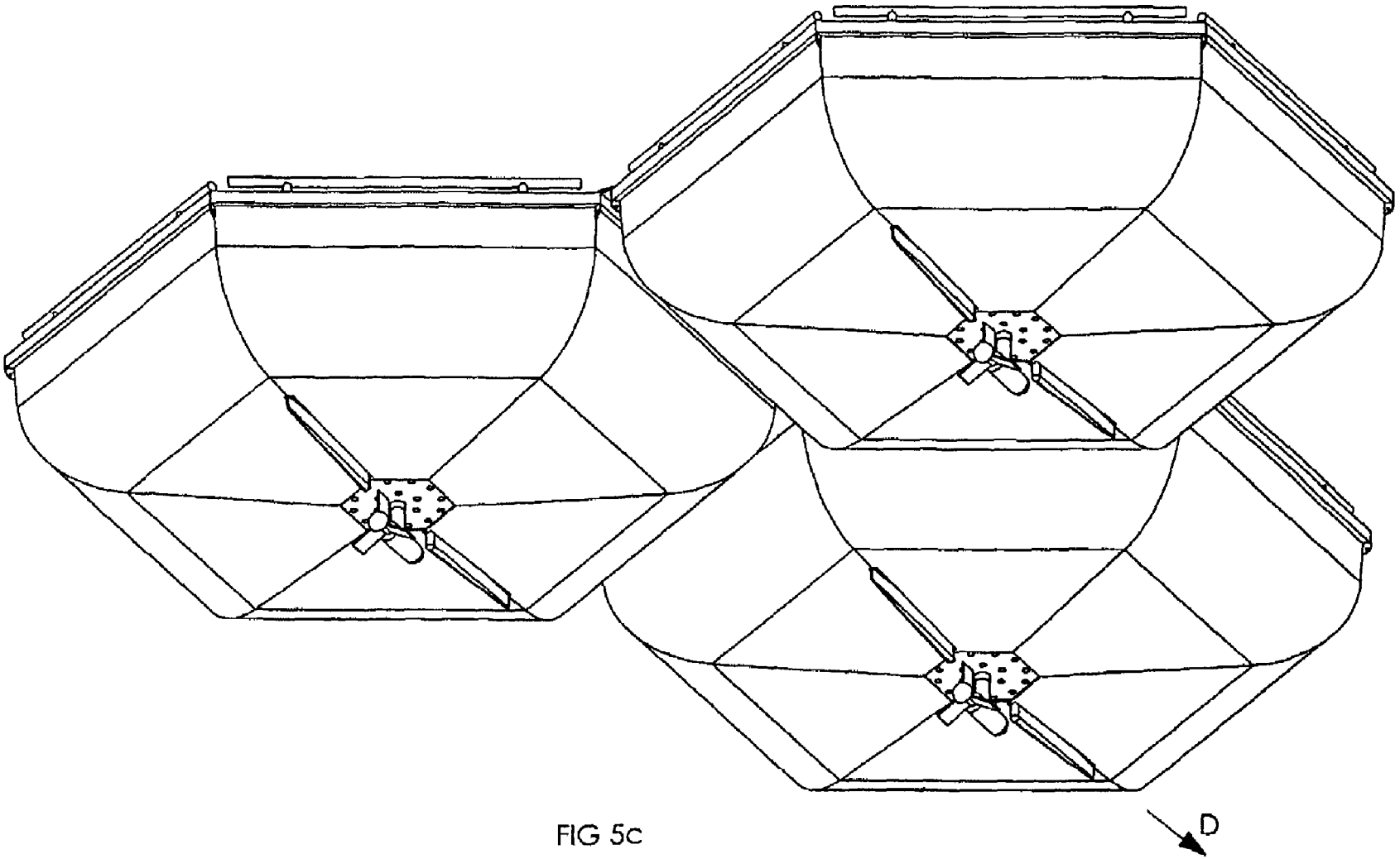
FIG. 5*c* is, in bottom perspective view, the three watercraft of FIG. 5*a*.

As seen in FIG. 5, a plurality of platform boats 10 may be releasably interlocked to one another to form a fixed adjacent array of such boats which, given a sufficient number, will form a mat of such boats although FIG. 5 only illustrates three hexagonal platform boats 10 interlocked.

Figure 8A:
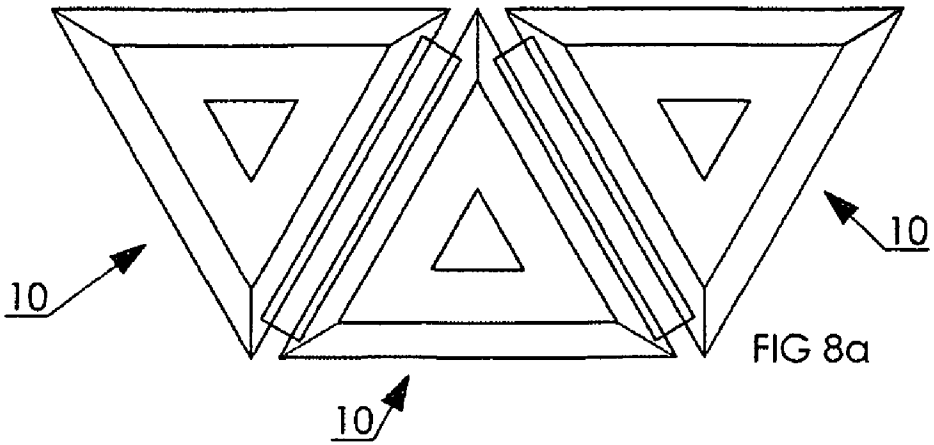
FIG. 8*a* illustrates diagrammatically a mat of three watercraft according to a further embodiment to the present invention wherein each watercraft is formed as a regular triangle in plan view.
Figure 8B:
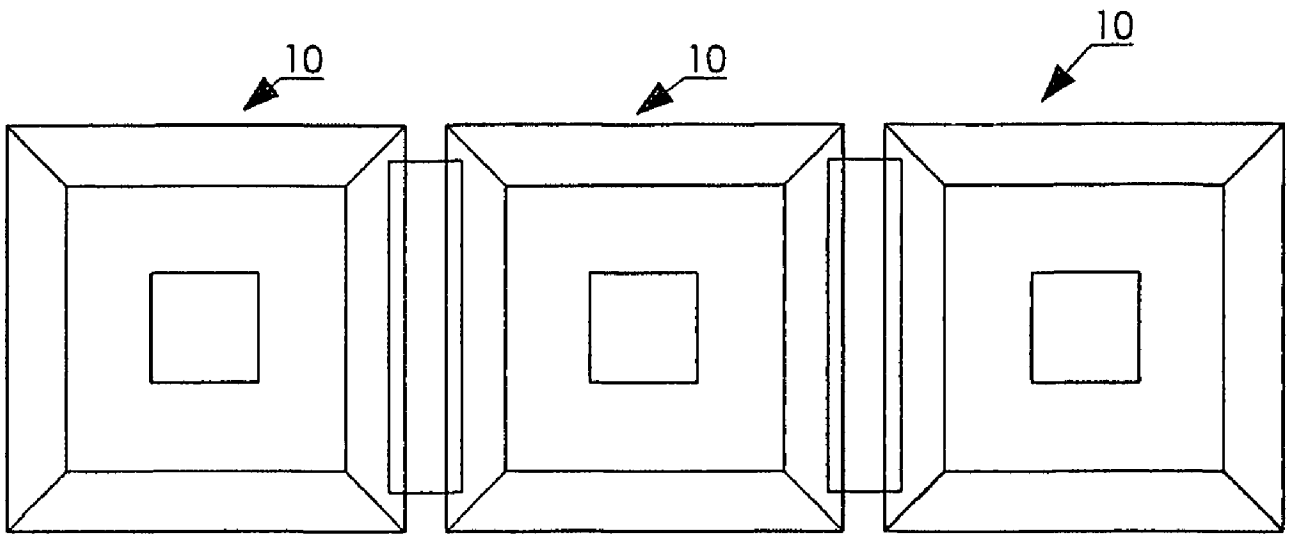
FIG. 8*b* is a further alternative embodiment illustrating diagrammatically a mat of three watercraft having their hulls shaped as square polygons when seen in plan view.

Thus on a relatively calm day, a flotilla of platform boats 10 may meet and join up with one another to provide for socializing and/or assistance amongst boats in cooperative fishing or other such uses as would be accommodated by the "gapless" interlocking of the highly maneuverable boats 10. As stated above, the boats may be hexagonal in planform or for example may be other regular polygon planforms such as illustrated by way of example in FIGS. 8*a* and 8*b*. Note how, in a two-dimensional array of such planforms, gaps between adjacent boats may be substantially eliminated, especially by the use of gunwale mats as described below.

In one embodiment, the interlocking mechanism for interlocking between adjacent boats 10 are gunwale mats such as flexible and resilient planar mat members 38 which resiliently interlock between corresponding adjacent linear portions of gunwale main frame 12*d*. Planar mat members 38 may be tough resilient mats which anchor to gunwale main frames 12*a* by means of anchor posts 40 which are rigidly mounted, for example by means of welds 12*b*, into anchor sockets 42 in main frames 12*a*. Rails 26 may be removably mounted onto posts 40. Advantageously, mats 38 are long enough to extend the entire length of the correspondingly linear portions of gunwales 12 and main frames 12*a*, and are shaped so as to snugly and contiguously abut at their ends against adjoining mats 38 being simultaneously used to interlock with another adjacent platform boat 10. Thus gaps between the gunwales of adjacent boats are avoided, thereby increasing the safety of the formed-up flotilla for passengers moving between boats, for children's fingers, etc. Mats 38 may advantageously be wide enough to provide for a consistent spacing between adjacent gunwales of adjacent platform boats 10 for example as to provide between a 2 inch and a 3 inch spacing between adjacent gunwales. This provides for restricted motion between adjacent platform boats as the surface 32*a* of the body of water 32 undulates beneath the boats. Thus in one embodiment, each mat 38 may have dimensions of 4-5 feet long and 8-9 inches wide and may be of for example a rubber or rubber-like compound having a thickness of approximately a ½ inch, and angled at its ends for abutting mating to form a contiguous cover over the gaps between boats.

Figure 4:
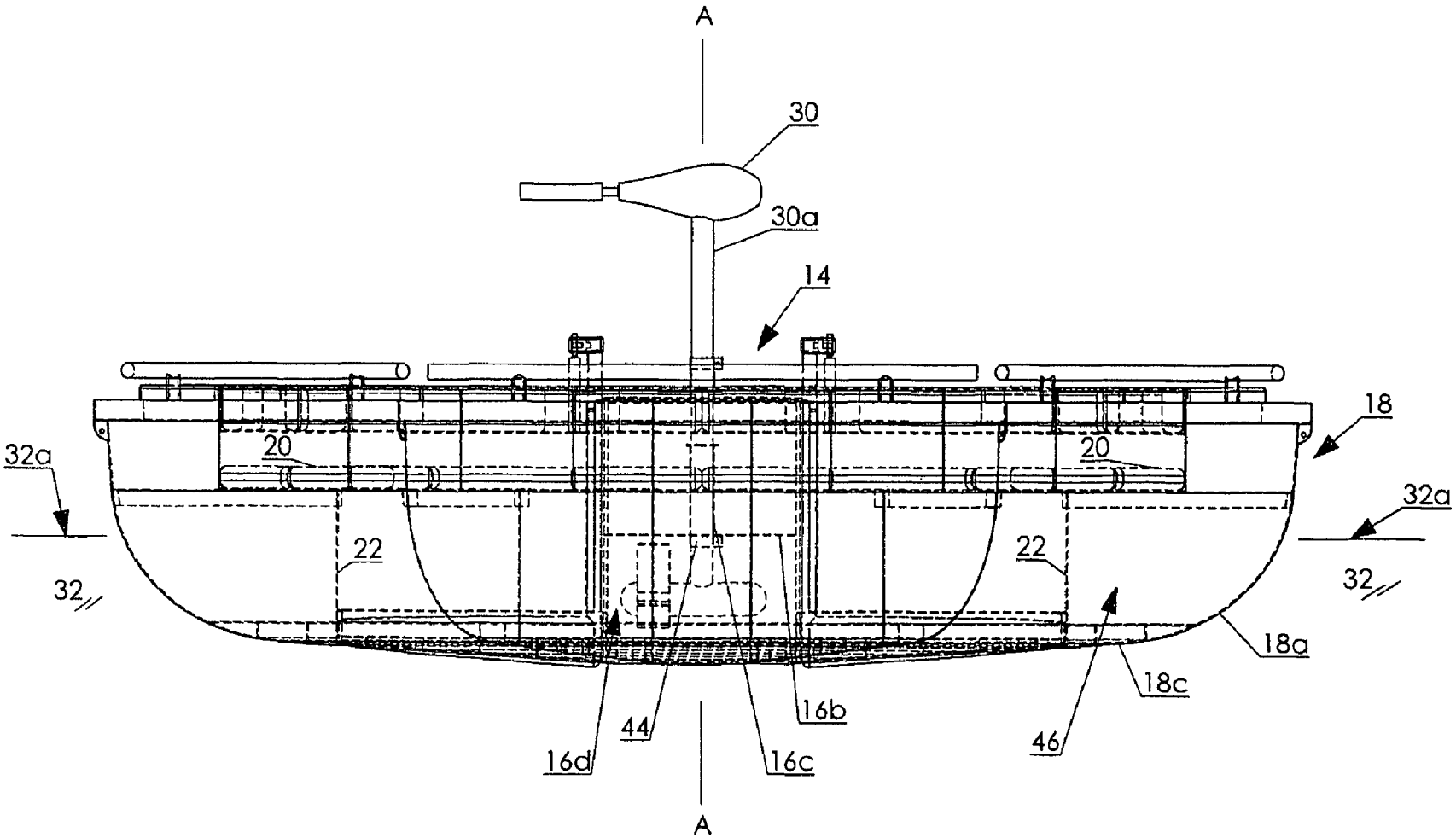
FIG. 4 is, in side elevation view, the watercraft of FIG. 3*b* showing the structures internal to the hull in dotted outline.

In one embodiment as better seen in FIG. 4, tower floor 16*b* is rigidly mounted by means of for example clamp 44 onto shaft 30*a* of motor 30. Thus as motor 30 is raised or lowered along axis A by the sliding of shaft 30*a* in motor mounts 28*a*, and supported on tower floor 16*b* by lower motor support 16*c*, the tower floor 16*b* will also be raised and lowered. Thus as may be seen in FIG. 3*c*, when the propellers 30*b* and motor unit 30*c* are lowered so that motor 30 may be used to translate hull 18 through the water, tower floor 16*b* is lowered to be substantially flush with hull base 18*c*. When motor 30 is retracted upwardly so as to protect the propellers and motor unit within cavity 16*d*, tower floor 16*b* is also elevated up into well 14.

Figure 9:
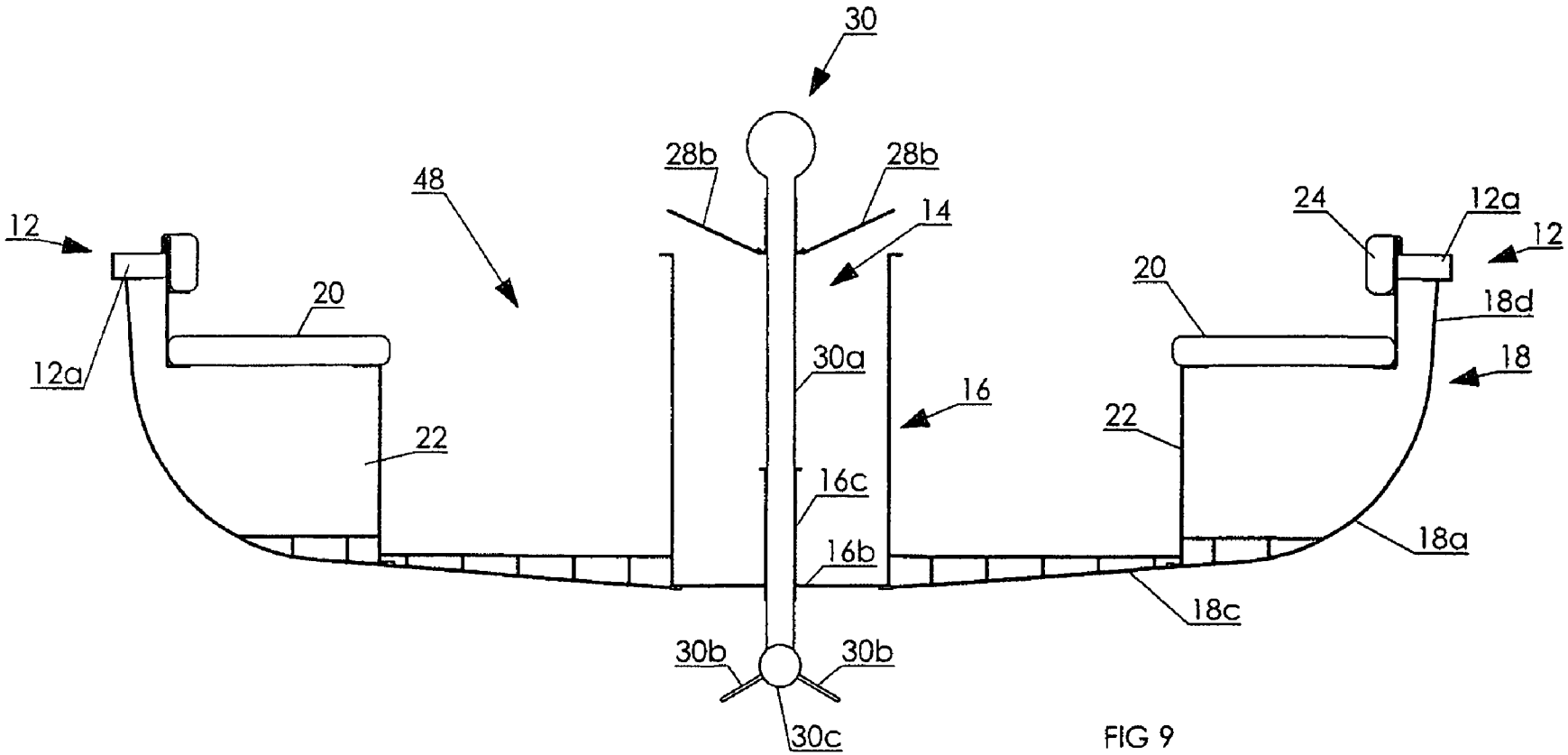
FIG. 9 is a simplified cross section through the watercraft of FIG. 1*a*.

As also understood upon a review of FIGS. 4 and 9, bulwarks 22, seats 20 and hull lower portion 18*a* define therebetween storage compartments 46 in which may be stored batteries for example in a rigidly spaced apart array around the perimeter of footwell 48 so as to balance the boat. The batteries may be cooperatively wired together by means of for example a circular wiring harness (not shown) by which motor 30 may be powered.

As will be known to one skilled in the art, hull 18 may be constructed of a sandwich of aluminium skin over foam, or may be constructed by mould processes known in the art for forming fibreglass hulls and the like. Advantageously, in one embodiment of the platform boat 10 of the present invention, a bimini top may be provided which may be mounted on a rigid framework extending over the passenger compartment defined by the seats and footwell. Covers or tops may be secured to tow-eyes 50 which are spaced-apart around the upper edge of the hull 18. Further, small fold-down or fold-up tables (not shown) may be mounted to the tower 16. Solar panels (not shown) may be mounted on the covers or tops to re-charge the batteries.

Figure 6:
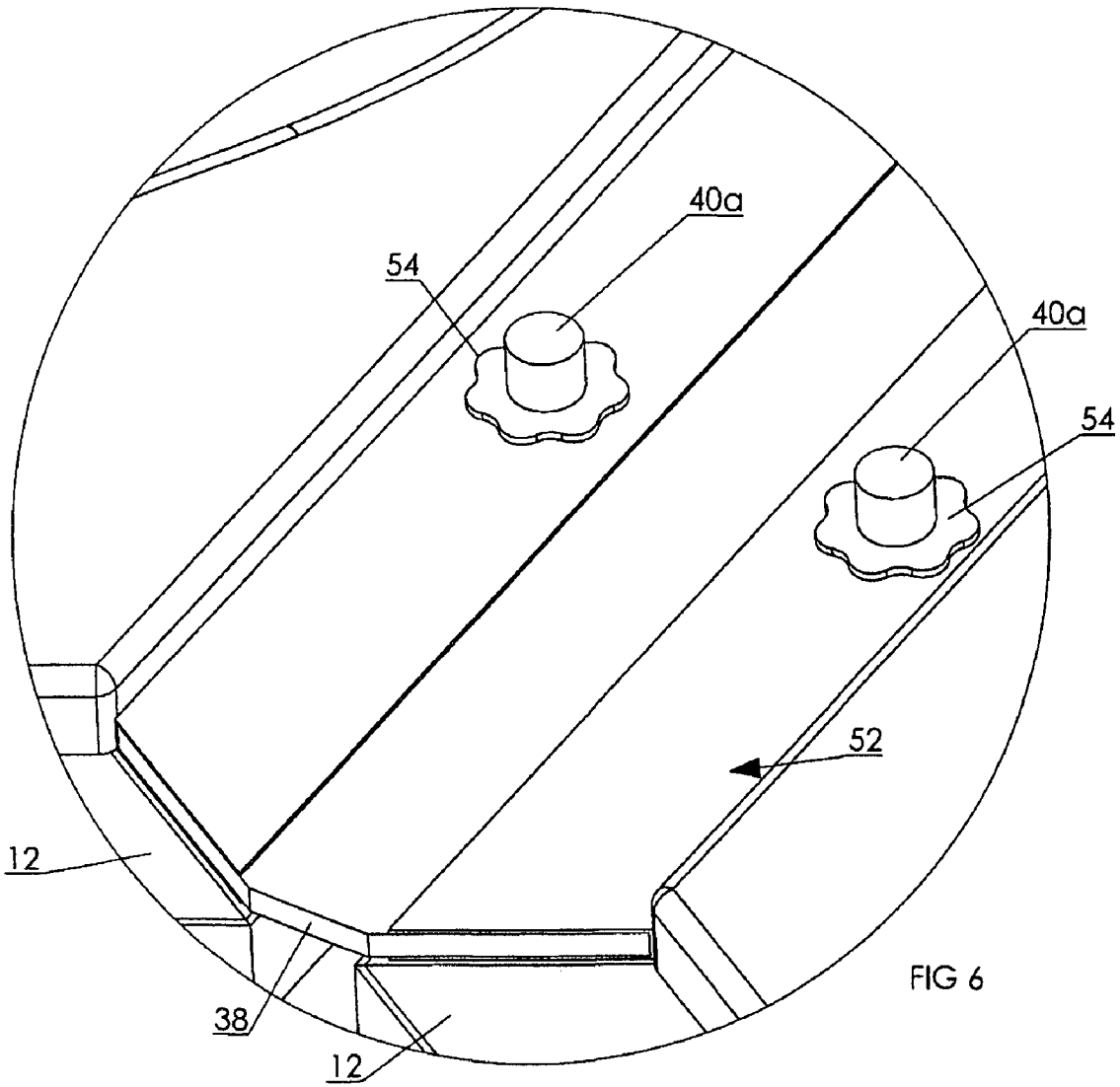
FIG. 6 is an enlarged view of a portion of FIG. 5*a*.
Figure 7:
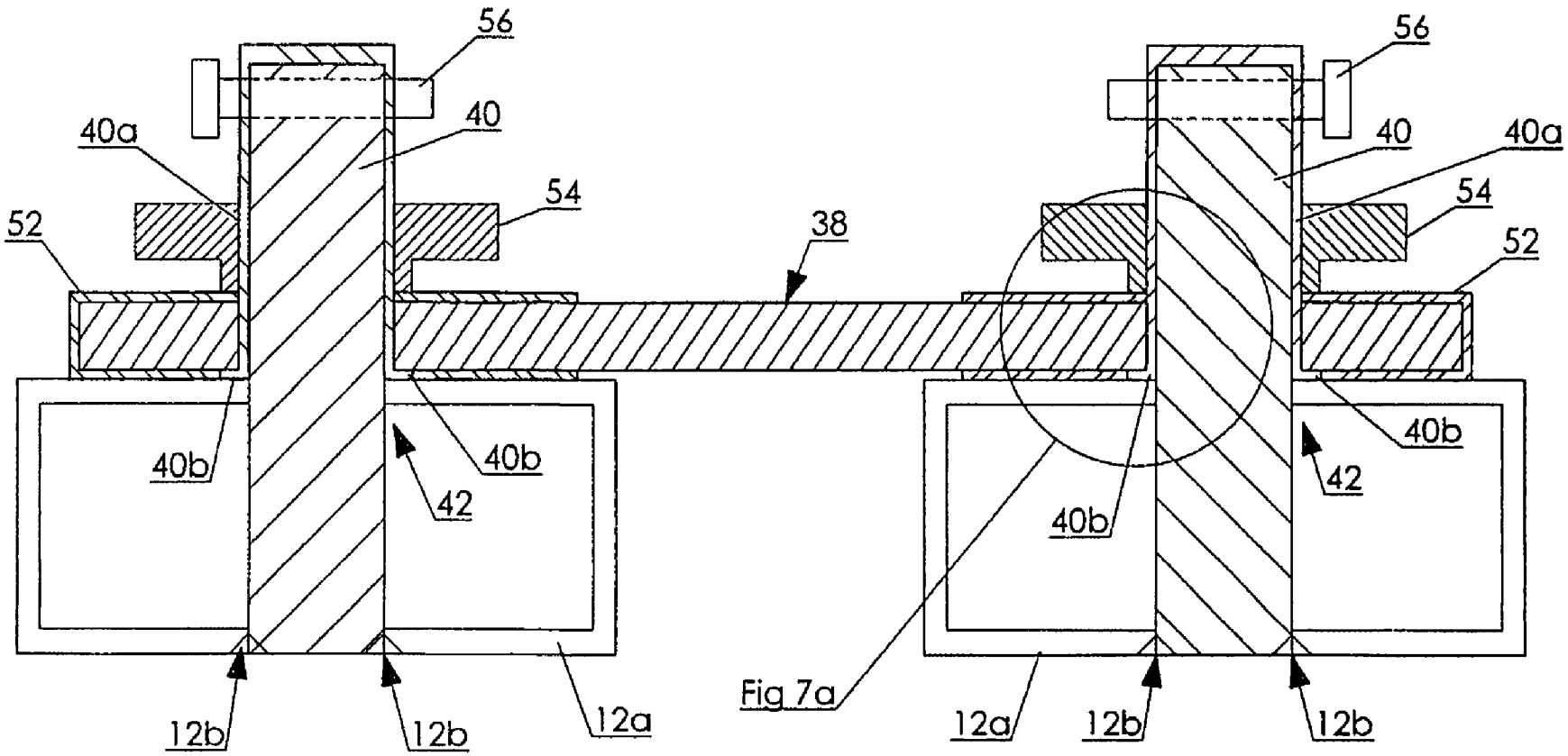
FIG. 7 is a section view along line 7-7 in FIG. 5*b*.
Figure 7A:
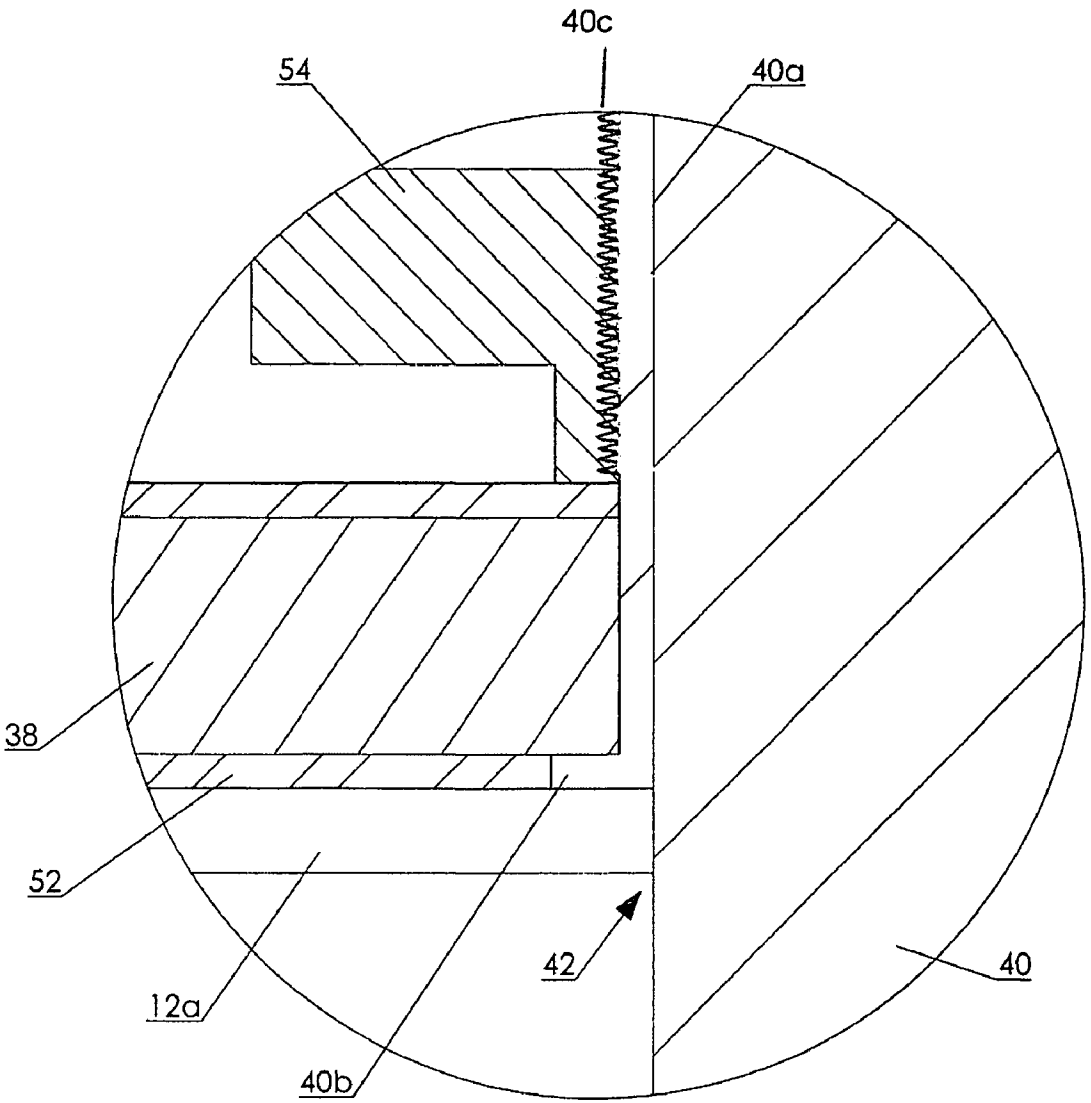
FIG. 7*a* is an enlarged view, partially cut away, from FIG. 7.

As better seen in FIGS. 6, 7 and 7*a*, each mat 38 is firmly held on its corresponding gunwale main frame 12*a* by u-shaped clamps 52. Clamps 52 clamp the long edges of mat 38 and are held in place securely down onto main frames 12*a* by threaded lock-down collars 54 which screw downwardly onto the upper threaded ends of compression sleeves 40*a*, where threads 40*c* are shown in FIG. 7*a*. The sleeves 40*a* are snugly fitted over the upper ends of posts 40. As collars 54 are screwed downwardly onto threads 40*c*, sleeves 40*a* are urged upwardly against the return downward biasing force of lower rim flanges 40*b* pulling up against resilient mat 38. Sleeves 40*a* translate slightly upwardly to pinch pins 56 and thereby retain them through sleeves 40*a* and posts 40. Collars 54 compress clamps 52 and pinch mats 38 downwardly onto main frames 12*a*. Thus with anchor posts 40 securely mounted into sockets 42, collars 54 may be screwed down along sleeves 40*a* onto clamps 52. Locking pins 56 are journalled in corresponding cross-bores in the upper-most ends of sleeves 40*a* and pins 40. Again, it is advantageous from a safety point of view that the ends of mats 38 are angled to abut closely to prevent gaps in covering of the spaces between adjacent boats.

In use as a flotilla, a plurality of boats 10 once joined up, may be motored in direction D as seen in FIG. 56 for example. Bow wave or wake 58 is shown merely to illustrate direction of movement over water and is not intended to imply that only the configuration of FIG. 5*b* will work. To the contrary, it may be desirable that the flotilla move in any direction, which may be obtained by all boats completely raising their rudders and setting their motors in a common direction. Advantageously hover, the flotilla will track better if directed along the parallel keel lines C of all the boats with their rudders lowered to their keel position, which in FIG. 5*b* means translation either in direction D or in the opposite direction. One of the boats, for example either the lead boat, or the rear-most boat may have one or both rudders completely lowered for steering the flotilla while powered by all of the boat motors.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A water craft comprising:

a hull having a gunwale substantially continuously therearound defining a regular polygon in shape around said gunwale, said gunwale having at least first, second, and third sides contiguous to one another, said hull having retractably mounted thereto an oppositely disposed pair of elongate substantially horizontally extending first and second rudders each independently rotatably mounted to said hull by a corresponding substantially parallel spaced apart pair of substantially vertical steering shafts, said shafts defining therebetween a keel line along a lowermost portion of said hull, said rudders rigidly mounted to lowermost ends of said shafts so as to lie along said keel line when said rudders are co-linearly aligned, wherein rotation of one or both of said shafts pivots one or both of said rudders correspondingly, Wherein upper ends of said shafts extend upwardly along and are mounted to a rigid steering tower rigidly mounted substantially centrally in a footwell cavity defined by said hull, said steering tower having a central hollow core, said hollow core hollow between a lower-most opening in said hull between said lowermost ends of said shafts and an upper opening in said tower adapted for rotatable mounting into an operative position of a motor thereto so as to operatively position a throttle and steering control of the motor above said tower and a lowermost propulsion end of the motor below said tower and hull.

2. The watercraft of claim 1 wherein said shafts are vertically displaceable relative to said tower between a stowed position wherein said rudders are snugged up against said hull in a fixed orientation aligned along said keel line, and a lowered position clear of said hull for free-steering of said rudders relative to said hull.

3. The watercraft of claim 2 wherein said hull further comprises a channel formed in said hull along said keel line, and wherein said rudders in said stowed position mate at least partially into said channel for fixing said fixed orientation along said keel line.

4. The watercraft of claim 3 wherein said shafts are telescopically mounted in said tower.

5. The watercraft of claim 4 wherein said shafts further comprise rudder steering handles on said upper ends of said shafts for steering of said rudders.

6. The watercraft of claim 5 wherein said hollow core is a waterwell when said hull is floating in a body of water whereby the water in said core rises to a level in said core substantially equal to a waterline of said hull.

7. The watercraft of claim 6 wherein the motor is mountable in the upper end of said tower by a collar assembly mounted to said tower for rotatably supporting the motor in said core so as to depend downwardly from said collar assembly to engage the propulsion end of the motor into the water below said hull.

8. The watercraft of claim 7 wherein collar assembly is releasably mountable onto the motor and adapted so as to provide for selectively raising and lowering the motor relative to said collar assembly.

9. The watercraft of claim 7 further comprising gunwale mounts mountable to said gunwales for mounting said hull alongside another watercraft.

10. The watercraft of claim 9 wherein said another watercraft is substantially identical to said watercraft and said gunwale mounts mount said watercraft closely adjacent said another watercraft.

11. The watercraft of claim 10 wherein said gunwale mounts are planar members mountable along one side thereof to said gunwales of said watercraft and mountable at an opposite side thereof to the corresponding gunwales of said another watercraft.

12. The watercraft of claim 1 wherein said planar members are resilient.

13. The watercraft of claim 9 further comprising rails releasably mounted to said gunwales, wherein said rails are mounted to said gunwales by means of anchors mounted in said gunwales.

14. The watercraft of claim 12 wherein said gunwale mounts are mountable to said anchors by anchor means, once said rails have been de-mounted from said anchors.

15. The watercraft of claim 10 wherein said polygon is a hexagon.

16. The watercraft of claim 7 further comprising at least one seat mounted around a corresponding portion of an inner circumference of said gunwales.

17. The watercraft of claim 16 further comprising a footwell between said at least one seat and said tower.

18. The watercraft of claim 17 wherein said at least one seat is a plurality of seats extending substantially entirely around said inner circumference of said gunwales.

19. The watercraft of claim 17 further comprising at least one storage compartment under a corresponding said at least one seat.

20. The watercraft of claim 7 wherein said tower and said collar assembly are adapted to allow 360 degree rotation of the motor relative to said tower for selectively urging said hull in any direction over the surface of the body of water.

* * * * *